US006047639A

United States Patent [19]

Shih

[11] Patent Number: 6,047,639

[45] Date of Patent: Apr. 11, 2000

[54] INK REFILLABLE STAMP

[76] Inventor: Shiny Shih, No. 31, Lane 349, Chungcheng S. Rd., Yungkang City, Tainan Hsien, Taiwan

[21] Appl. No.: 09/428,179

[22] Filed: Oct. 27, 1999

[51] Int. Cl.[7] ..... B41K 1/42

[52] U.S. Cl. ..... 101/333; 101/327

[58] Field of Search ..... 101/103, 104, 101/108, 101, 98, 97, 125, 327, 333, 334

[56] References Cited

U.S. PATENT DOCUMENTS

| | | | |
|---|---|---|---|
| 3,478,682 | 11/1969 | Funahashi | 101/368 |
| 3,832,947 | 9/1974 | Funahashi | 101/327 |
| 4,432,281 | 2/1984 | Wall et al. | 101/334 |
| 5,048,415 | 9/1991 | Shih | 101/103 |
| 5,899,142 | 5/1999 | Suda et al. | 101/125 |
| 5,974,969 | 11/1999 | Okumura et al. | 101/327 |
| 5,979,323 | 11/1999 | Hirano | 101/333 |

*Primary Examiner*—Christopher A. Bennett
*Attorney, Agent, or Firm*—William E. Pelton, Esq.

[57] ABSTRACT

An ink-refillable stamp includes a knob, fixed seat, a moving seat movably connected to the fixed seat, a stamping set securely inserted in the fixing seat and a bottom cover. The stamping set consists of an upper frame and a lower frame combined together. At least one ink-spongy pad and a stamping face are housed in the stamping set. At least one partition strip can be provided in the stamping set to separate the inner space into at least two rooms for filling with ink-spongy pads and inks of different colors therein. A plurality of apertures is defined in the upper frame to let ink to be supplied therefrom. When the ink stored in the stamp is exhausted, the stamp can be cleanly and conveniently refilled by a new ink cartridge wherefrom ink flows through the apertures into the stamping set.

4 Claims, 7 Drawing Sheets

INK REFILLABLE STAMP

BACKGROUND OF THE INVENTION

1. Field of the Invention

The present invention relates to an improved ink-refillable stamp, wherein an inner space for storing ink therein can be partitioned into at least two rooms to be filled with respective ink supplies of different colors.

2. Description of Related Art

There are various ink stamps, such as logo stamps, document delivery stamps, C.O.D. stamps, etc. which are commonly used in offices.

As shown in FIG. 10, a conventional ink-refillable stamp comprises a moving seat (80), a top cap (81), a fixing seat (82), a spring (83) and an inner stamping set (84).

The moving seat (80) and the fixing seat (82) are correspondingly formed in an inverted U shape. The fixing seat (82) thereon integrally forms an upright slide post extended through the moving seat (80) and securely fixed by the top cap (81) on the top thereof. The fixing seat (82) is received in the moving seat (80) with the spring (83) provided around the slide post of the fixing seat (82) and compressed between the top cap (81) and the moving seat (80), whereby the moving seat (80) is movably connected with the fixing seat (82).

The inner stamping set (84) includes an upper frame (85) and a lower frame (86), which are combined together and securely inserted in the inner space of the fixing seat (82). The upper frame (85) defines a plurality of slots (851) therein with an ink spongy pad (852) housed therein. The lower frame (86) defines a plurality of recesses (861) to fix stamping types (87) therein, and a peripheral recess (862) to fix border blocks (88) therein.

The stamping types (87) and border blocks (88) can be easily replaced, and ink can be refilled via the slots (851) into the stamping set (84) after drawing it out of the fixing seat (82). The ink spreads in the ink spongy pad (852) on the stamping face.

However, the above ink-refillable stamp has the following defects:

1. when a user is adding ink into the stamp, it is difficult to avoid inking hands of a user; and the quantity of ink refilling is not well-controllable;
2. the ink can not spread evenly in the stamp, so that the quality of imprints is restricted;
3. the ink stamp can be supplied with ink of only one color.

Other information concerning the application is, for example, the U.S. Pat. No. 5,048,415 filed by the inventor of the present invention on May 30, 1990.

Therefore, it is an objective of the invention to provide an improved ink-refillable stamp to mitigate and/or obviate the aforementioned problems.

SUMMARY OF THE INVENTION

An improved ink-refillable stamp includes a knob, a fixed seat, a moving seat movably connected to the fixed seat, a stamping set and a bottom cover. The stamping set consists of an upper frame and a lower frame, which are combined together and detachably inserted in the fixing seat. At least one ink-spongy pad and a stamping face are housed in the stamping set. At least one partition strip can be provided in the upper frame to separate the inner space into at least two rooms for filling with ink-spongy pads and ink of different colors therein. A plurality of apertures is defined in the upper frame to let ink be refilled therefrom. When the ink stored in the stamp is exhausted, the stamp can be cleanly and conveniently refilled by a new ink cartridge whereby ink flows from the apertures into the stamping set.

Other objects, advantages and novel features of the invention will become more apparent from the following detailed description when taken in conjunction with the accompanying drawings.

DETAILED DESCRIPTION OF THE PREFERRED EMBODIMENT

Figure 1:
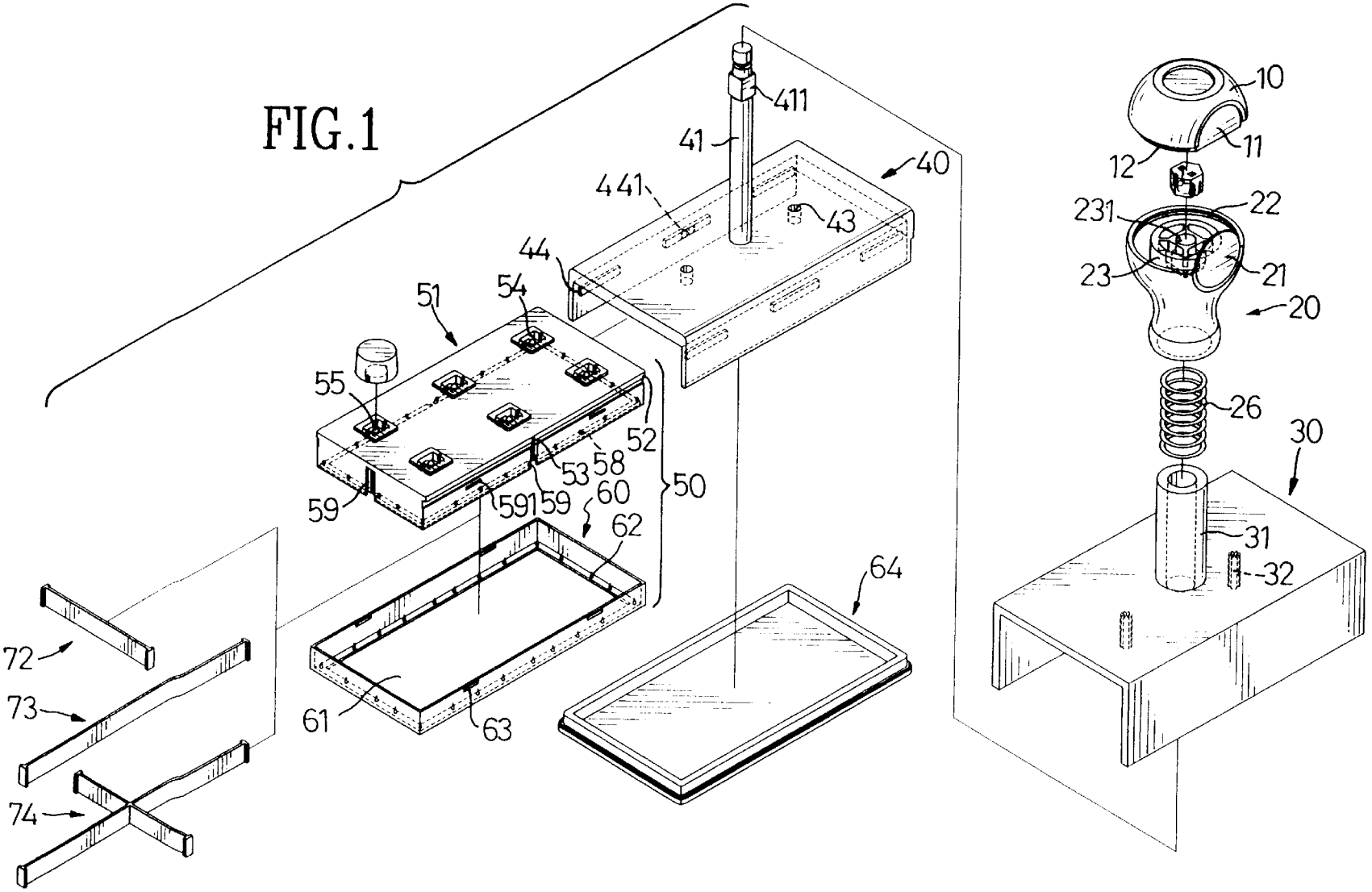
FIG. 1 is an exploded perspective view of an ink-refillable stamp in accordance with the invention.
Figure 2:
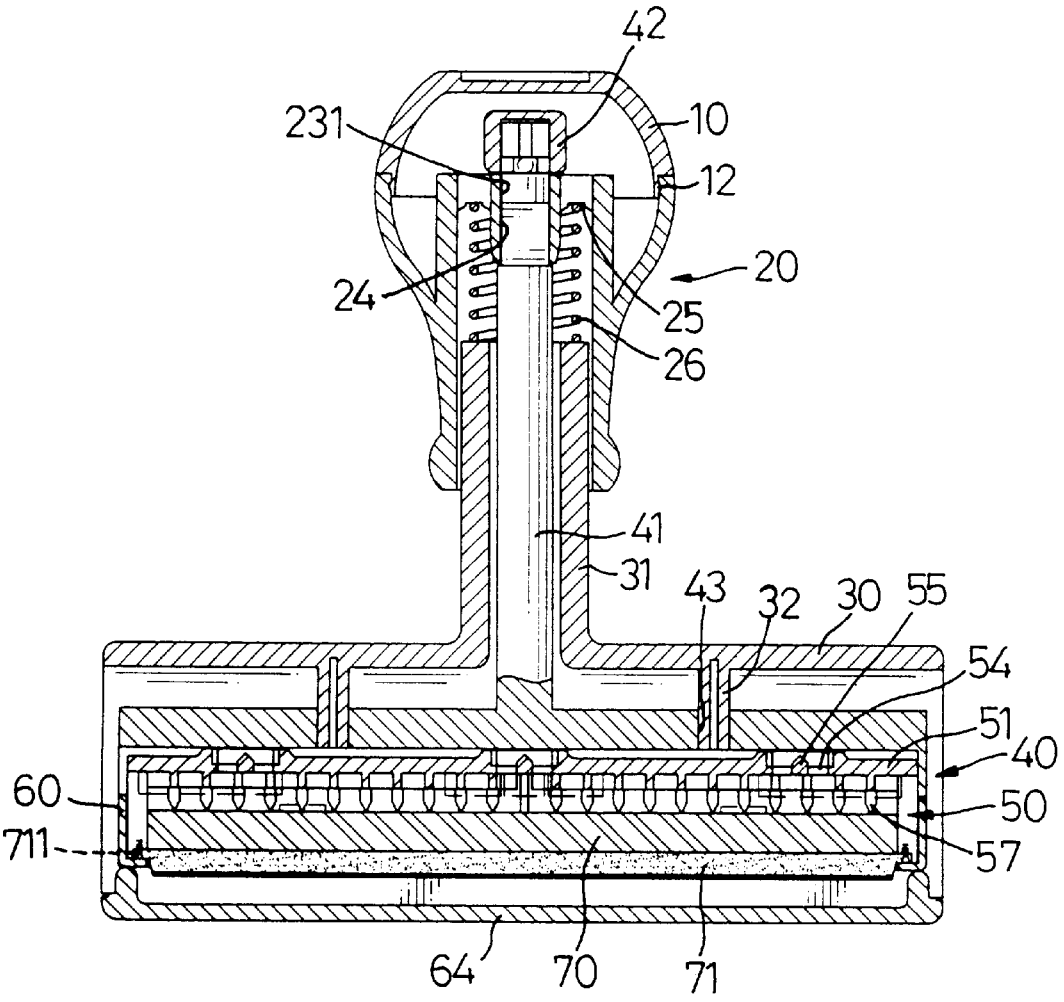
FIG. 2 is a cross sectional view of an assembled ink-refillable stamp in accordance with the invention.

As shown in FIGS. 1 and 2, the present invention relates to an improved ink-refillable stamp comprising a knob (20) with a detachable top cap (10) covered thereon, a moving seat (30) movably connected with a fixing seat (40) and a stamping set (50) detachably inserted in the fixing seat (40).

The top cap (10) has a flat (11) formed at one side and a lip (12) around the bottom periphery thereof. The knob (20) forms an extended flat plate (21) at one side corresponding to the flat (11) and a bulged edge (22) around the top periphery thereof corresponding to the lip (12) of the top cap (10). The top cap (10) is secured on the knob (20) by respective mating between the flat (11) and the flat plate (21), and the lip (12) and the bulged edge (22). The center of the knob (20) forms a central joint portion (23), which defines a passage therein. An upper portion of the passage is defined as a circular passage (231) and a lower portion thereof is defined as a polygonal passage (24).

The moving seat (30) is formed in an inverted U shape with two opposite side walls and a top surface extending therebetween, with an upright tube guide (31) formed on the top surface thereof and two positioning posts (32) formed on the bottom surface thereof.

The fixing seat (40) is also formed in an inverted U shape adapted to being fitted in the inner space of the moving seat (30). An upright slide post (41) is formed on the top surface of the fixing seat (40) and corresponds to the tube guide (31). Two positioning holes (43) corresponding to the positioning posts (32) are defined in the top surface of the fixing seat (40). A top end portion of the slide post (41) forms a circular portion and a polygonal portion (411) corresponding to the circular passage (231) and polygonal passage (24) of the knob (20). The fixing seat (40) is received in the inner space of the moving seat (30), with the top end of the slide post (41) extended through the tube guide (31) of the moving seat (30), and the positioning posts (32) of the moving seat (30) respectively extended through the positioning holes (43) of the fixing seat (40). The slide post (41) further extends through the passage of the knob (20) with the polygonal portion (411) fitted in the polygonal passage (24), and is fixed with a fastening cap (42) on the top end thereof, whereby a rotation of the knob (20) is prevented. A spring (26) is provided around the slide post (41) and compressed between the bottom surface (25) of the joint portion (23) and the top face of the tube guide (31) of the moving seat (30), whereby the moving seat (30) is movably connected with the fixing seat (40). A pair of slideways (44) is integrally formed on the inner surfaces of the opposite side-walls of the fixing seat (40), each slideway has a ridge (441) formed thereon.

The stamping set (50) includes an upper frame (51) and a lower frame (60), combined together. At least one ink-spongy pad (70) and a stamping face (71) are housed in the upper frame (51).

The upper frame (51) forms a pair of flanges (52) at opposite sides near the top end thereof to be slidable along the corresponding slideway (44). Each of the flanges (52) defines a recess (53) therein corresponding to the ridge (441) of the slideway (44), whereby, when the stamping set (50) is inserted into the fixing seat (40), the ridges (441) are respectively inserted into the corresponding recesses (53) to fix the stamping set (50) with the fixing seat (40).

Figure 3:
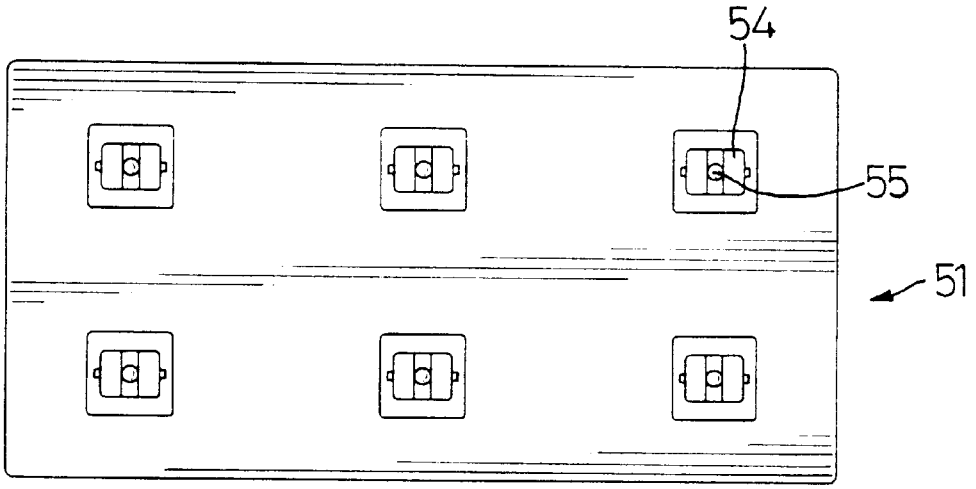
FIG. 3 is a top view of a first embodiment of a fixing seat of the ink-refillable stamp in accordance with the invention.
Figure 4:
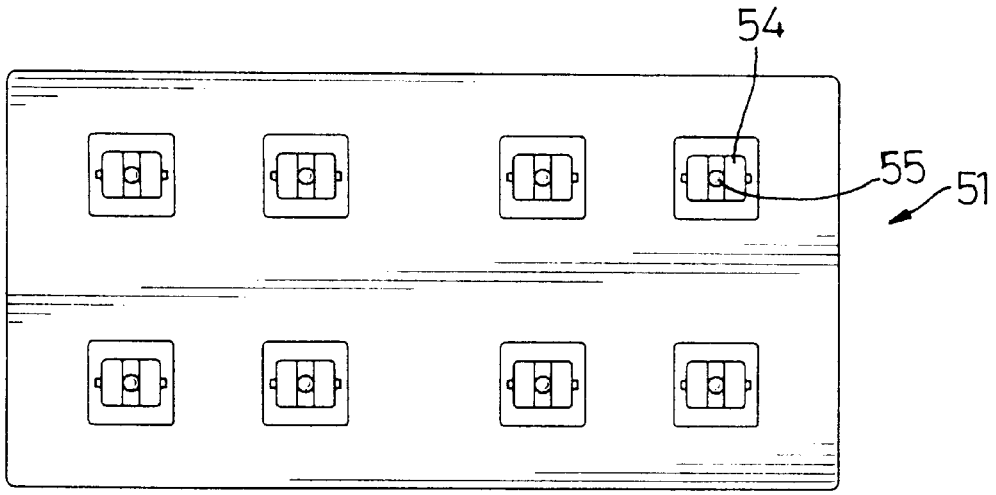
FIG. 4 is a top view of a second embodiment of the fixing seat of the ink-refillable stamp in accordance with the invention.
Figure 5:
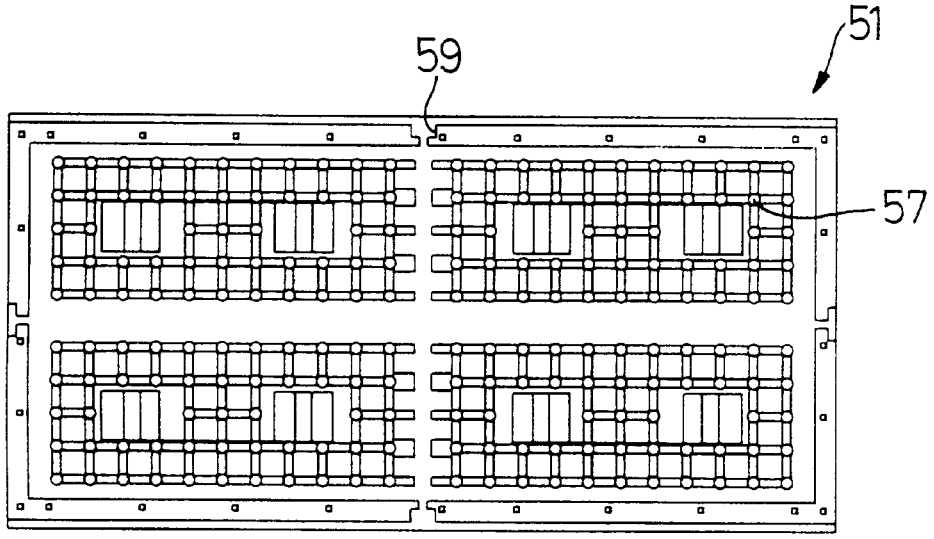
FIG. 5 is a bottom view of the second embodiment of the fixing seat of the ink-refillable stamp in accordance with the invention.

As seen in FIGS. 3 and 4, two embodiments according the present invention have a group of apertures (54) defined in the upper frame (51), which is arranged in two rows with three or four of the equal spaced apertures (54) in one row. Each aperture (54) forms an up extending spike (55) on a central joint portion thereof.

As clearly shown in FIG. 2, the inner bottom face of the upper frame (51) forms a plurality of equal spaced contacting pins (57) extending downward to press the ink spongy pad (70) against the stamping face (71).

A plurality of equal spaced positioning eyes (58) is defined in the bottom of the peripheral walls of the upper frame (51). Opposite walls of front/back and right/left sides of the upper frame (51) respectively define a groove (59) in the center thereof.

The lower frame (60) has peripheral walls with an opening (61) defined thereamong to expose the stamping face (71) therefrom.

A plurality of equal spaced positioning pins (62) is formed on the top face of the peripheral wall of the lower frame (60) and extends upward corresponding to the positioning eyes (58) of the upper frame (51). After the ink-spongy pad (70) and the stamping face (71) are housed in the upper frame, the lower frame (60) is fixed on the bottom of the upper frame (51) with the positioning pins (62) respectively extended through corresponding eyes (711) of the stamping face (71) and fixedly inserted in the corresponding positioning eyes (58) of the upper frame (51). The peripheral wall of the lower frame (60) further has stop ridges (63) integrally formed thereon corresponding to recesses (591) defined in the peripheral walls of the upper frame (51). Therefore, the lower frame (60) is securely combined with the upper frame (51) to secure the ink-spongy pad (70) and stamping face (71) therebetween.

A bottom cover (64) is adapted to cover the bottom of the moving seat (30) to protect the stamping face (71).

Figure 6:
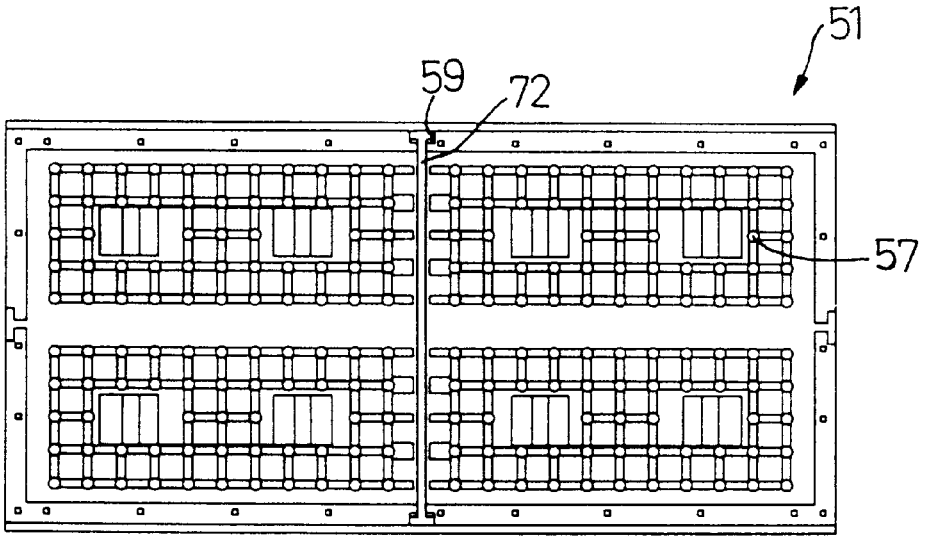
FIG. 6 is a bottom view of the second embodiment of the fixing seat of the ink-refillable stamp in accordance with the invention, showing a transversal partition strip provided thereon.

Referring to the FIG. 6, a first partition strip (72) is transversally arranged in the upper frame (51) with opposite ends thereof respectively inserted in a relative one of the grooves (59). The first partition strip (72) separates the inner space of the upper frame (51) into two rooms, which are provided by relative ink-spongy pads (70) and filled with respective different color inks.

Figure 7:
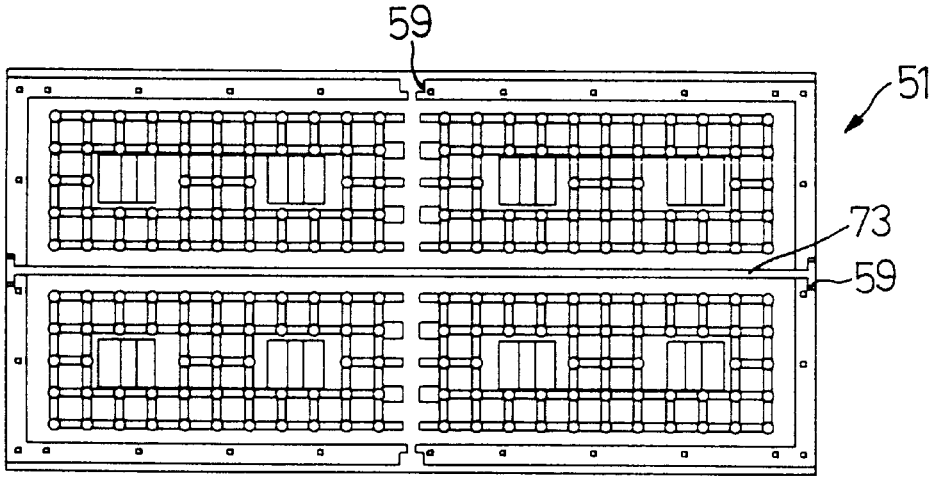
FIG. 7 is a bottom view of the second embodiment of the fixing seat of the ink-refillable stamp in accordance with the invention, showing a longitudinal partition strip provided thereon.
Figure 8:
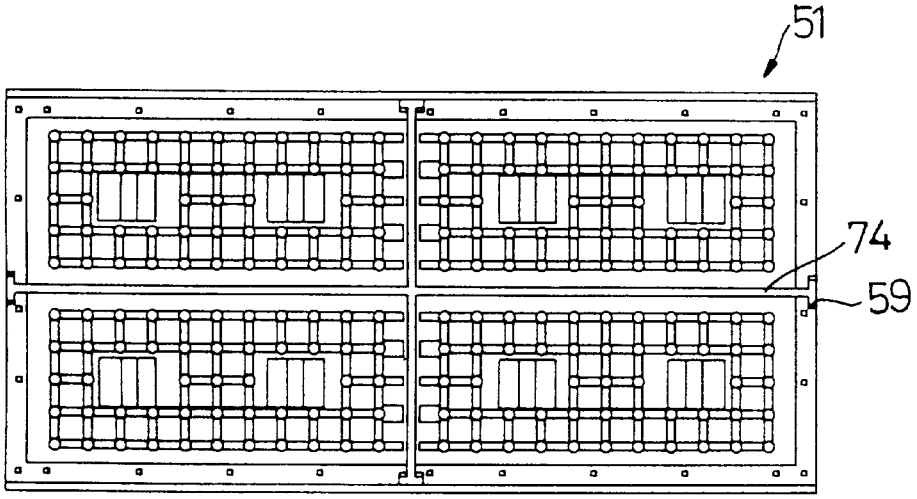
FIG. 8 is a bottom view of the second embodiment of the fixing seat of the ink-refillable stamp in accordance with the invention, showing a cross partition provided thereon.

In FIG. 7, a second partition strip (73) is longitudinally arranged in the upper frame (51). A cross partition (74) as seen in FIG. 8 is provided in the upper frame (51) to separate the inner space of the stamping set (50) into four areas. Therefore, the practicability of the present invention is increased.

Figure 9:
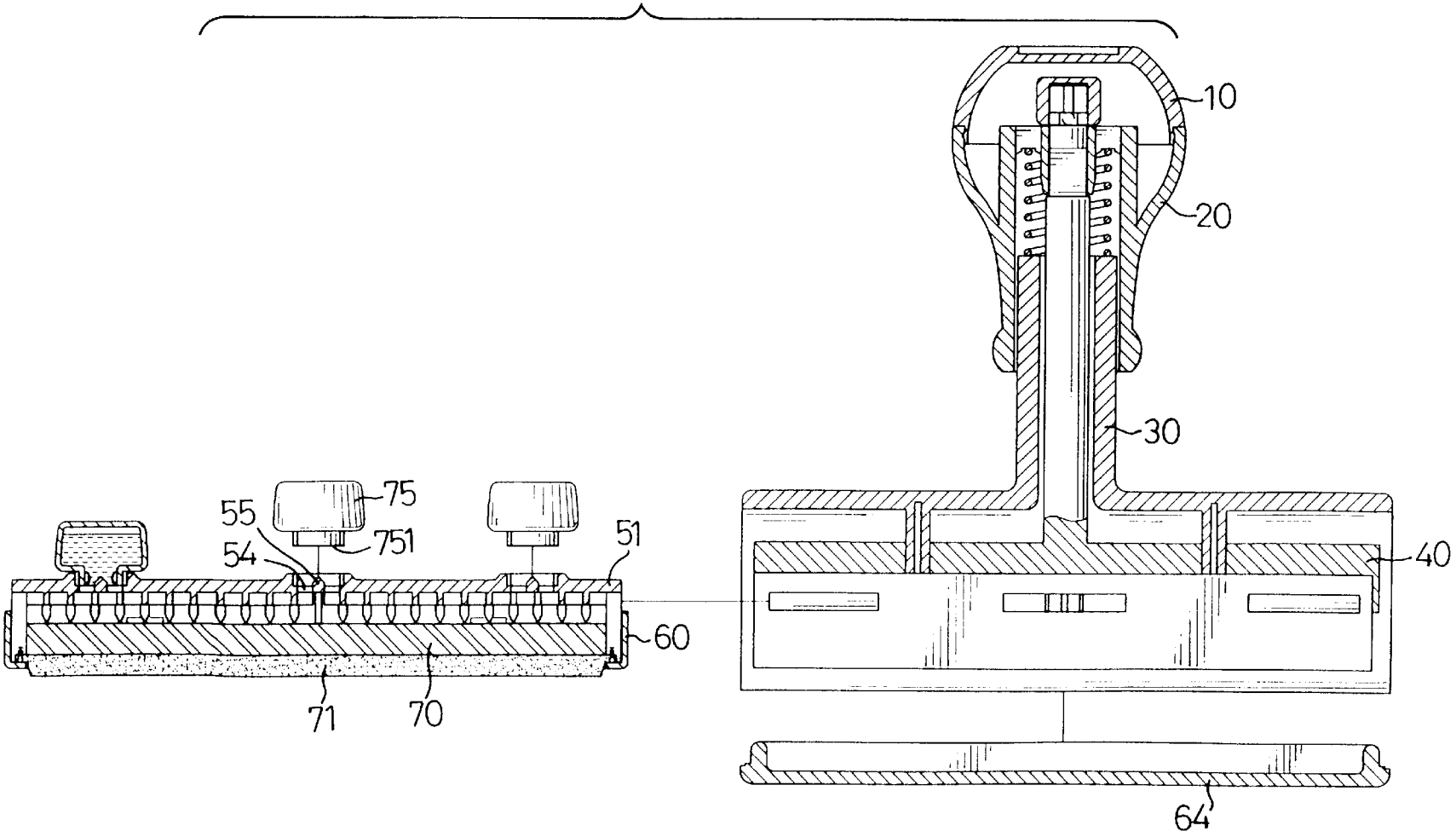
FIG. 9 is a cross sectional schematic view of the present invention, showing ink refilling of the stamp.
Figure 10:
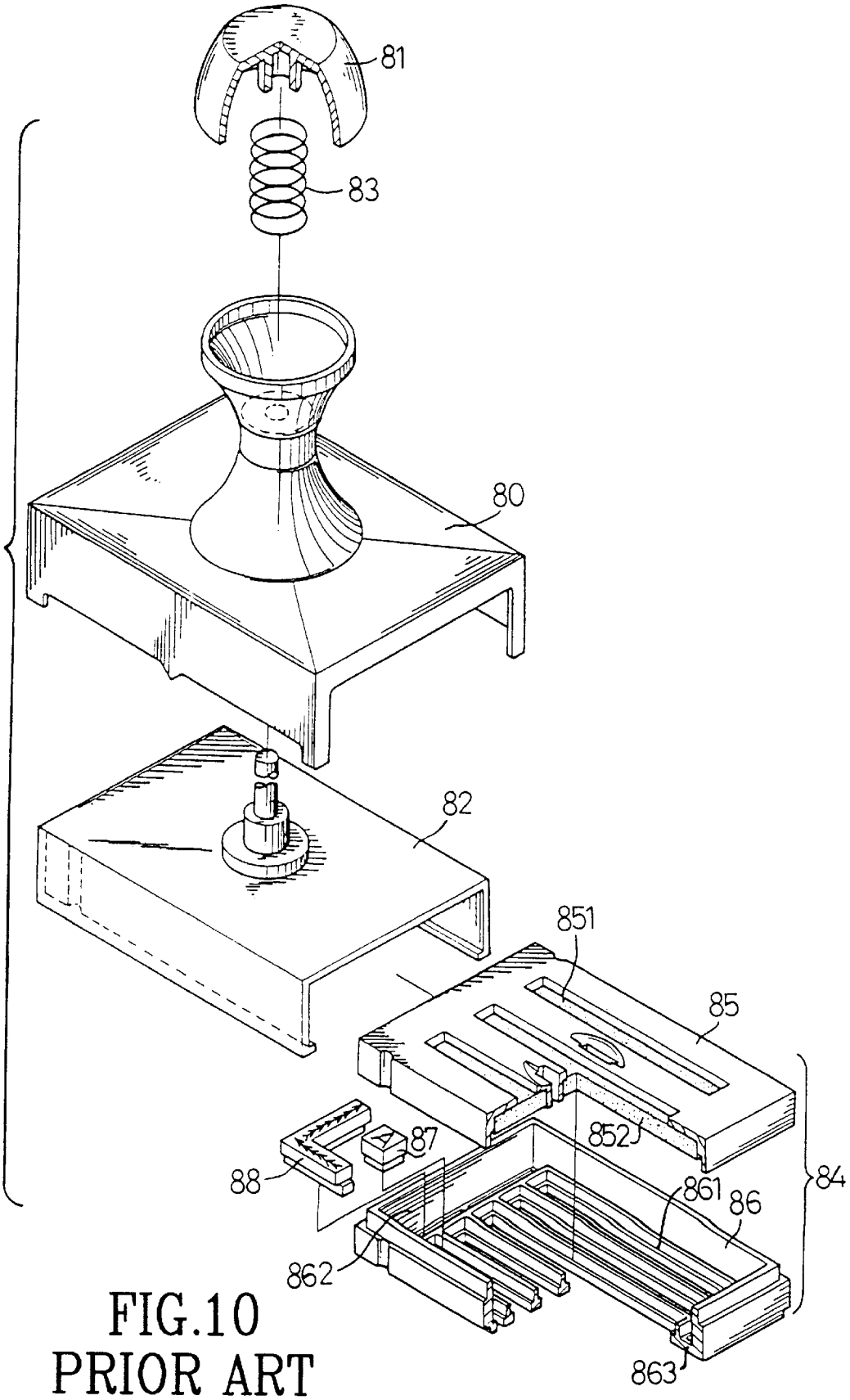
FIG.10 PRIOR ART
FIG. 10 is an exploded perspective view of a conventional ink-refillable stamp.

As seen in FIG. 9, when the ink stored in the stamp is exhausted, the stamping set (50) can be drawn out of the fixing seat (40). Then, an ink cartridge (75) introduced by the manufacturer of the stamp can be used to refill the stamping set (50). When the ink cartridge (75) is inserted in the respective aperture (54), the spike (55) penetrates through a seal (751) on the bottom of the ink cartridge (75) to allow ink to spread about in the space among the contacting pins (57). Thus, the ink evenly spreads on the stamping face (71).

From the above description, it is noted that the invention has the following advantages:

1. the ink-refillable stamp can be conveniently and cleanly refilled, the easy steps include drawing the stamping set (50) out of the fixing seat (40), supplying ink via the apertures (54) of the upper frame (51) of the stamping set (50) by the ink cartridges introduced by the manufacturer, whereby inking of a user's fingers is avoided and the quantity of refilling is controllable;
2. the stamping face (71) is securely positioned compared with the conventional art, and the ink can be evenly dispersed on the stamping face (71), so that the print quality of the ink stamp is increased;
3. the slide post (41) of the fixing seat (40) has the polygonal portion (411) engaged with the corresponding polygonal passage (24) defined in the knob (20), so that rotation of the knob (20) is prevented.
4. the partition strips (72) separating the stamping face (71) into rooms to be filled with inks of respective colors increases the practicability of the ink stamp.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An improved ink-refillable stamp comprising a knob (20), a moving seat (30) movably connected with a fixing seat (40), a stamping set (50) detachably inserted in the fixing seat (40) and a bottom cap (64); wherein the knob (20) has a central joint portion (23) formed therein with a passage defined therethrough;

the moving seat (30) integrally forms an upright tube guide (31);

the fixing seat (40) integrally forms an upright slide post (41) extended through the tube guide (31) of the moving seat (30), and further extended through the passage of the knob (20);

a spring (26) provided around the slide post (41) and compressed between the tube guide (31) of the moving seat (30) and a bottom surface (25) of the joint portion (23) of the knob (20);

the stamping set (50) includes an upper frame (51) and a lower frame (60) combined together;

characterized in that the upper frame (51) defines a plurality of apertures (54), each of which has a central joint portion forming an upright extending spike (55) thereon;

an inner bottom surface of the upper frame (51) includes a plurality of equal spaced and downwardly extending contacting pins (57) formed there;

at least one spongy pad (70) and a stamping face (71) are secured between the lower frame (60) and the contact pins (57) of the upper frame (51);

opposite walls of the upper frame (51) respectively define a groove (59) in the center thereof;

at least one partition is able to be fitted in the opposite grooves (59) to separate an inner space of the stamping set (50) into at least two rooms;

ink cartridges each with a sealed bottom are used to refill the stamp with ink via the apertures (54) of the upper frame (51).

2. The ink-refillable stamp as claimed in claim 1, wherein the lower frame (60) of the stamping set (50) forms a plurality of equal spaced positioning pins (62) on a top face of a peripheral edge thereof, and the upper frame (51) of the stamping set (50) correspondingly defines a plurality of equal spaced positioning eyes (58) in a bottom surface thereof, and the stamping face (71) also correspondingly defines a plurality of equal spaced eyes (711) therein around a periphery thereof.

3. The ink-refillable stamp as claimed in claim 1, wherein the central joint portion (23) of the knob (23) defines a polygonal passage (24) to receive a corresponding polygonal portion (411) of the slide post (41) of the fixing seat (40) therein.

4. The ink-refillable stamp as claimed in claim 1, wherein the moving seat (30) has two positioning posts (32) integrally formed on a bottom thereof to be fitted into corresponding positioning holes (43) defined in the fixing seat (40).

* * * * *